US006416207B1

(12) United States Patent
Chang

(10) Patent No.: US 6,416,207 B1
(45) Date of Patent: Jul. 9, 2002

(54) FLOOR LAMP WITH A PLURALITY OF ADJUSTABLE LIGHT-SOURCE CARRYING ARMS

(76) Inventor: William Chang, 7F-3, No. 92, Sec. 1 Yuen-Ping North Road, Taipei (TW)

( * ) Notice: Subject to any disclaimer, the term of this patent is extended or adjusted under 35 U.S.C. 154(b) by 0 days.

(21) Appl. No.: 09/566,433

(22) Filed: May 8, 2000

(51) Int. Cl.[7] ..... F21S 6/00

(52) U.S. Cl. ..... 362/419; 362/33; 362/250; 362/413; 362/414; 362/418

(58) Field of Search ..... 362/33, 249, 250, 362/251, 410, 413, 414, 418, 419, 421, 427

(56) References Cited

U.S. PATENT DOCUMENTS

| | | | | | |
|---|---|---|---|---|---|
| RE10,167 | E | * | 7/1882 | Barrie | 248/126 |
| 1,375,888 | A | * | 4/1921 | Baer | 403/55 |
| D105,588 | S | * | 8/1937 | Korengold | D26/60 |
| 2,352,496 | A | * | 6/1944 | Rose | 211/173 |
| 3,601,598 | A | * | 8/1971 | Horn | 362/418 |
| 4,121,280 | A | * | 10/1978 | Chapman et al. | 362/418 |
| 4,449,169 | A | * | 5/1984 | Warshawsky | 362/413 |
| 4,700,017 | A | * | 10/1987 | Morand | 174/86 |
| 4,726,552 | A | * | 2/1988 | Warshawsky | 248/122 |
| 4,744,019 | A | * | 5/1988 | Krogsrud | 362/402 |
| 4,827,389 | A | * | 5/1989 | Crum | 362/388 |
| 5,132,492 | A | * | 7/1992 | Wieder | 174/65 R |
| 5,424,931 | A | * | 6/1995 | Wheeler | 362/418 |

* cited by examiner

*Primary Examiner*—Sandra O'Shea
*Assistant Examiner*—Ismael Negron
(74) *Attorney, Agent, or Firm*—Brown & Michaels, PC

(57) ABSTRACT

A floor/table arm adjustable lighting fixture which illuminates each edge of the table, essentially comprised of a floor arm post, one end of the arm post is provided with sections at right angle to each other to be connected in sequence to a first tube, a second tube and a shade holding pipe; a primary light source is connected to said shale holding pipe; a pair of levers respectively extending from the outer circumference of said first and second tubes are alternatively arranged at a spacing of approximately 90 degrees; an extension lever of proper length is inserted to each of said levers, and a secondary light source is suspended from each of said extension lever for a proper length closer to each edge of the table.

7 Claims, 6 Drawing Sheets

FLOOR LAMP WITH A PLURALITY OF ADJUSTABLE LIGHT-SOURCE CARRYING ARMS

BACKGROUND OF THE INVENTION

1. Field of the Invention

The present invention relates to a floor or desk arm adjustable lighting fixture, and more particularly, to one dedicated to a square table to effectively improve the lighting at each edge for eye protection.

2. Description of Related Art

Many people tend to have a poker game, bridge, or mahjong at weekends or on holidays. To such occasion, usually a square table and a lighting fixture are required. The ceiling lamp is used, but the lighting may be poor due to the distance between the ceiling and the table. So a floor or table adjustable arm will be used to make sure that the light source is getting closer to the table.

FIG. 1 of the accompanying drawings shows a view of the prior art, wherein; a floor arm adjustable lamp 10 is provided by a table 11 for playing mahjong. Usually a U shape base 12 is provided to the lamp 10 and sandwiched by any of the four legs 13 of the table 11; an arm 14 is pivoted to the top of the lamp 10 and a bulb with a shade 15 is provided at one end of the arm 14. Blocks of mahjong 17 are arranged in row along each edge 16 of the table 11 by each player during the game.

Whereas the light source from the bulb shade 15 is usually turned to where close to the center of the top 18 of the table 11 from the direction 19 projecting to the top 18 as illustrated by the dotted line in FIG. 1, the side 171 of the mahjong 17 exposed to the light source gets brighter while the other side 172 tends to get comparatively darker, and even worse should the light source be stronger or the distance between the light source and the top 18 of the table 11 be shorter. It usually takes several hours to play the game, and the player is troubled by reading the figure or pattern indicated by the block of mahjong 17 as it is opposite to the light source, causing damage to the vision of the player.

SUMMARY OF THE INVENTION

The primary purpose is to provide an improved structure to a floor/table arm adjustable lighting fixture for protecting the vision of the players with comfortable and sufficient lighting.

To achieve the purpose, two tubes are provided in sequence to the arm at where closer to a primary light source, a pair of levers each allowing adjustment of its angle is provided to each tube and extending towards to each edge, and each lever is provided with a secondary light source which is adjustable by the corresponding player.

DETAILED DESCRIPTION OF THE PREFERRED EMBODIMENTS

Figure 2:
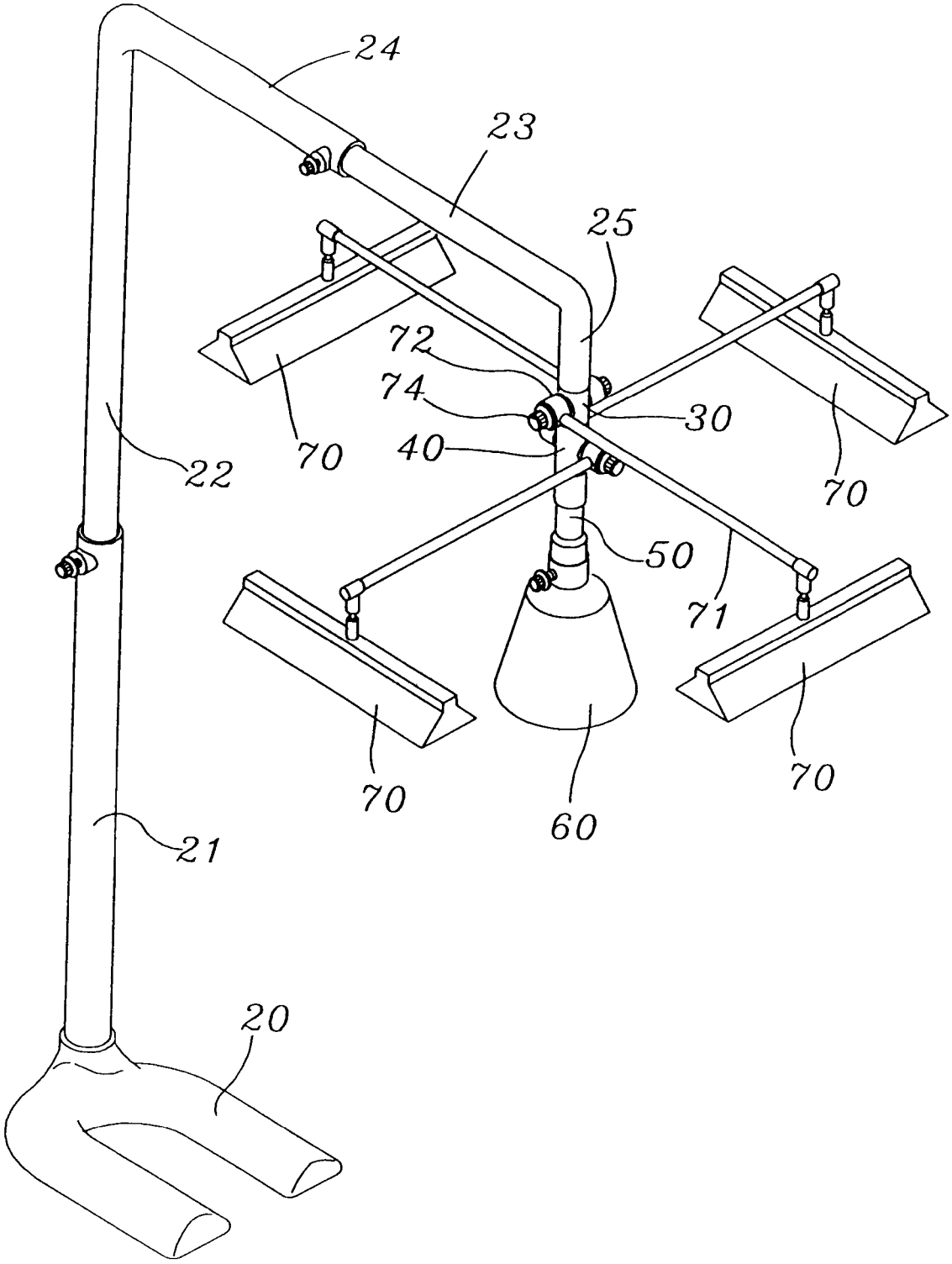
FIG. 2 is a perspective view of the preferred embodiment of the present invention.
Figure 3:
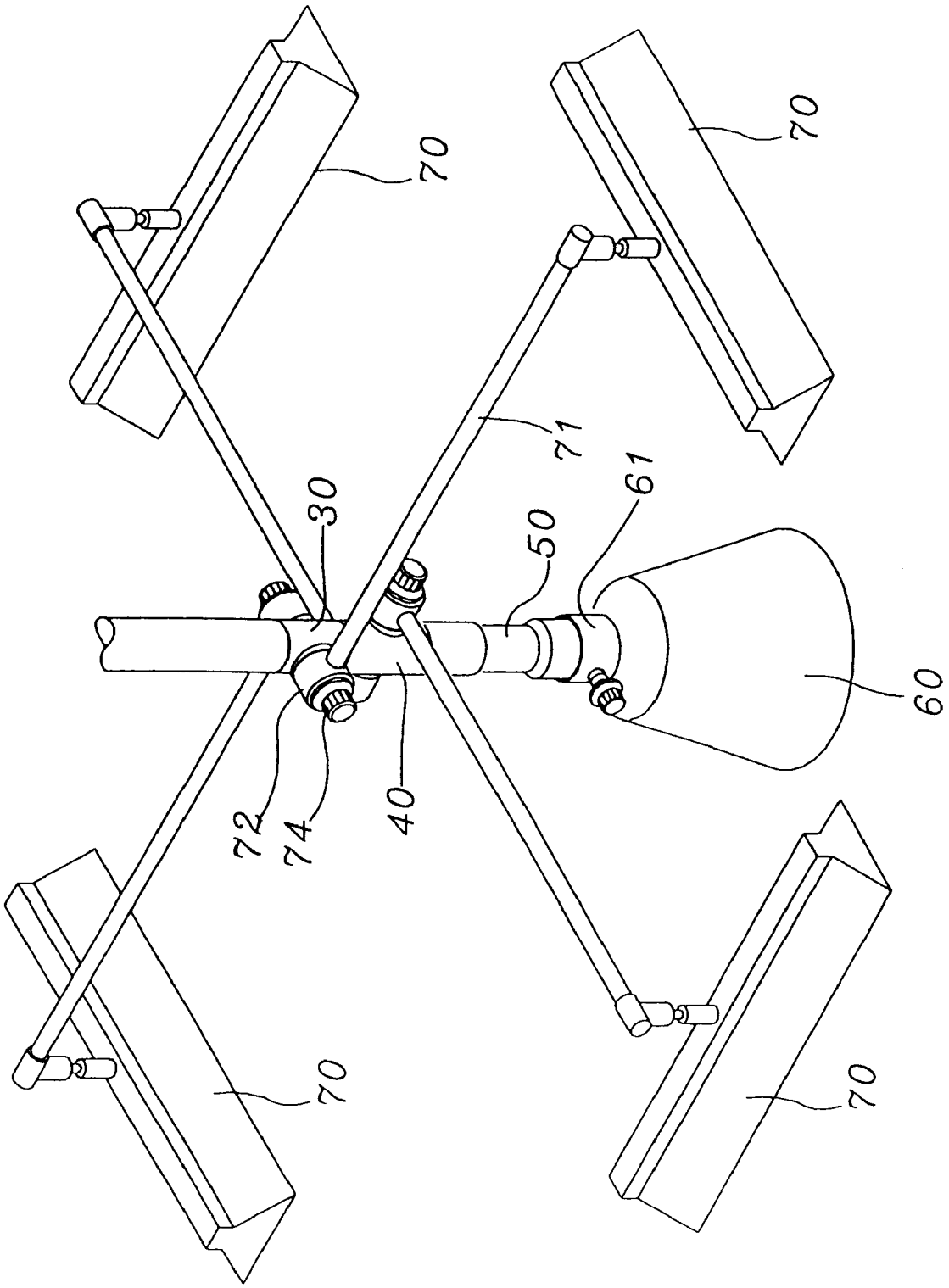
FIG. 3 is a blowout view taken from FIG. 2 without a post.

In the preferred embodiment of the present invention as illustrated in FIGS. 2 and 3, a floor or table arm adjustable lamp is provided at its U shape base 20 a post 21 which is connected to a first L-pipe 22 and a second L-pipe 23. Within, the length of a section 24 at a right angle to the first L-pipe and that of the section L-pipe 23 constitute the total length of the post 21 extending to the top of the table. A section 25 from the second L-pipe 23 heads down toward the central of the table top and is connected in sequence with a first tube 30, a second tube 40 and a shade holding pipe 50. A shade 60 for the primary light source is then mounted to the pipe 50. In this embodiment, the post 21, the first L-pipe 22, the second L-pipe 23, the section 24, and the section 25 together preferably create an arm post.

Figure 4:
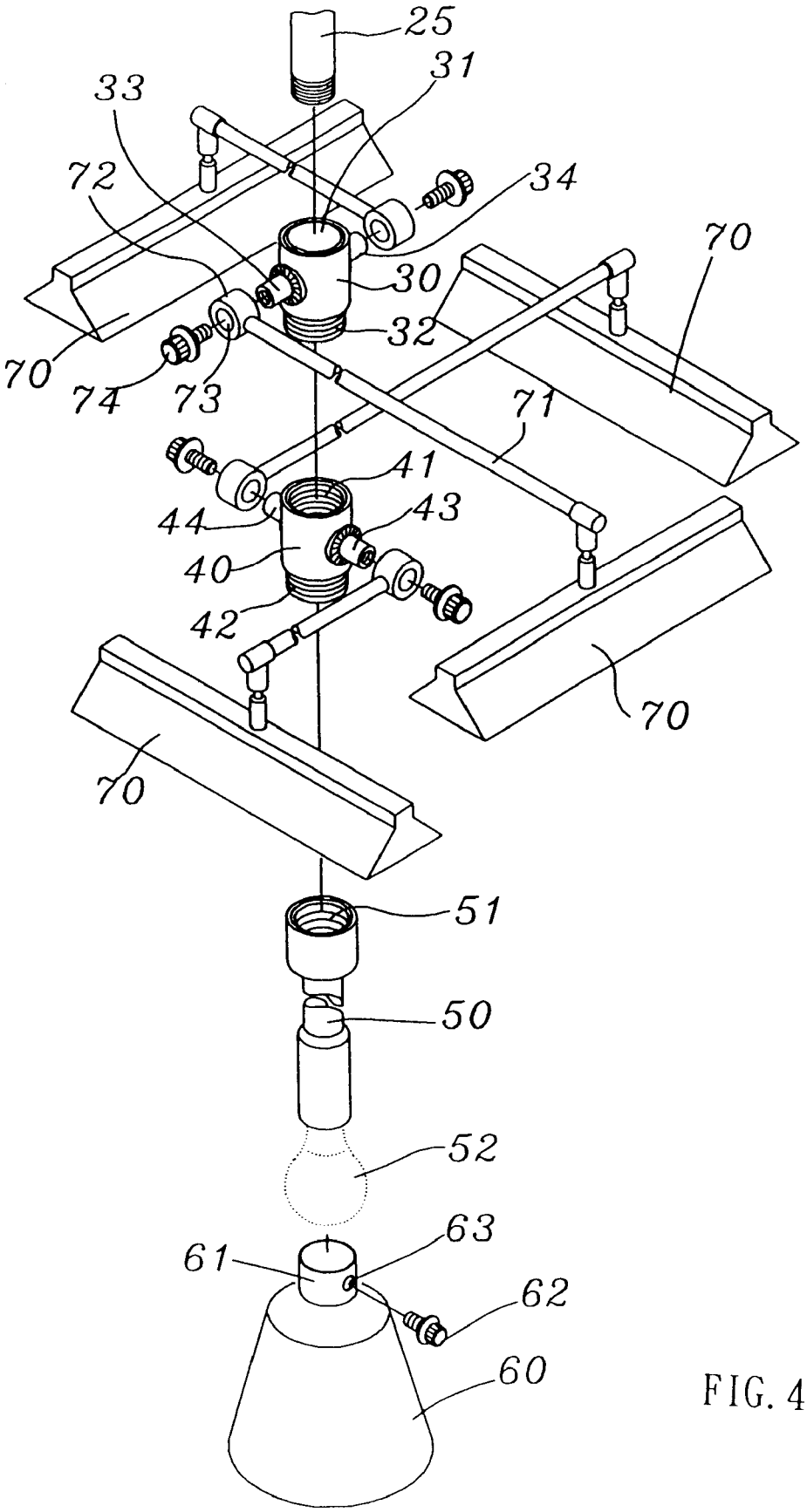
FIG. 4 is a view showing the breakdown of elements taken from FIG. 3.

As illustrated in FIG. 4, both of the first tube 30 and the second tube 40 are substantially identical, however, a pair of levers extending from the tube 30 are each respectively alternating from that extending from the tube 40. Within, the first tube 30 is comprised of a hollow body 31, a threaded end 32 and a pair of levers 33, 34 respectively extending from the outer circumference approximately at the middle section of the first tube 30. Each of the levers 33 and 34 is provided with an inner threaded bore of a proper depth. The second tube 40 is also provided with a threaded end 42, a pair of levers 43 and 44 in the same shape of that of the levers 33 and 34, and an inner threaded bore 41 to connect to the threaded end 32 from the first tube 30. Both tubes 30 and 40 are connected in such a way that levers 33 and 34 are each at an alternating angle to that of each of the levers 43 and 44, preferred at a space of 90 degrees.

Each of those levers 33, 34, 43 and 44 is respectively inserted with a secondary light source 70 extending downward for a proper length. An extension lever 71 is provided to the secondary light source 70. A connection head 72 is provided at one end of the extension lever 71. In the preferred embodiment, said connection head 72 is provided with an opening 73 to receive the lever 33 and fixed in position with a bolt 74 while the secondary light source 70 is provided at the other end of the extension lever 71. The secondary light source 70 relates to a light tube with a rectangular shade and it is preferred that the secondary light source 70 is pivoted to the other end of the extension lever 71 with a universal joint as illustrated in FIG. 5.

The threaded end 42 to the second tube 40 below the first tube 30 is screwed to the inner threaded bore 51 provided at the top of the shade holding pipe 50, and the shade holding pipe 50 is screwed at its base to the primary light source 52. In the preferred embodiment, the primary light source 52 relates to a light bulb. A shade 60 is inserted to the shade holding pipe before the installation of said primary light source 52. A connection rod 61 is provided to the shade 60 to be inserted to the shade holding pipe 50, then locked up with a screw 62 through its radial hole 63. As illustrated in FIG. 5, the light projection area b is smaller when the entire shade 60 is positioned at a lower location as represented by the solid line; while the light projection area a is larger when positioned at a higher location as represented by the dotted line.

Figure 5:
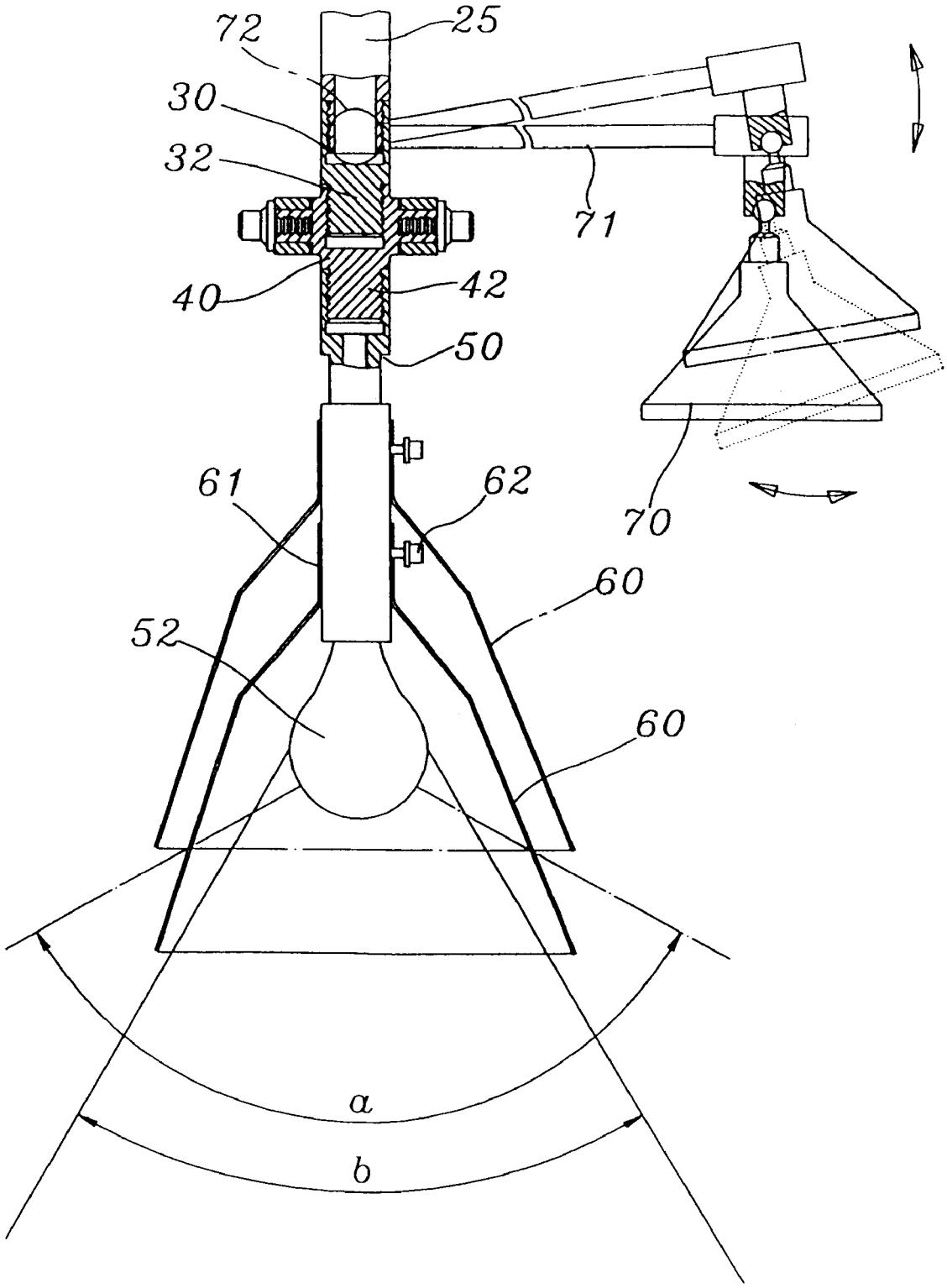
FIG. 5 is a schematic view showing sections of the primary and secondary light sources and their adjustment.

Also as illustrated in FIG. 5, the secondary light source assembled according to the aforesaid structure permits the adjustment of its height with the connection head 72 as the axis.

Figure 1:
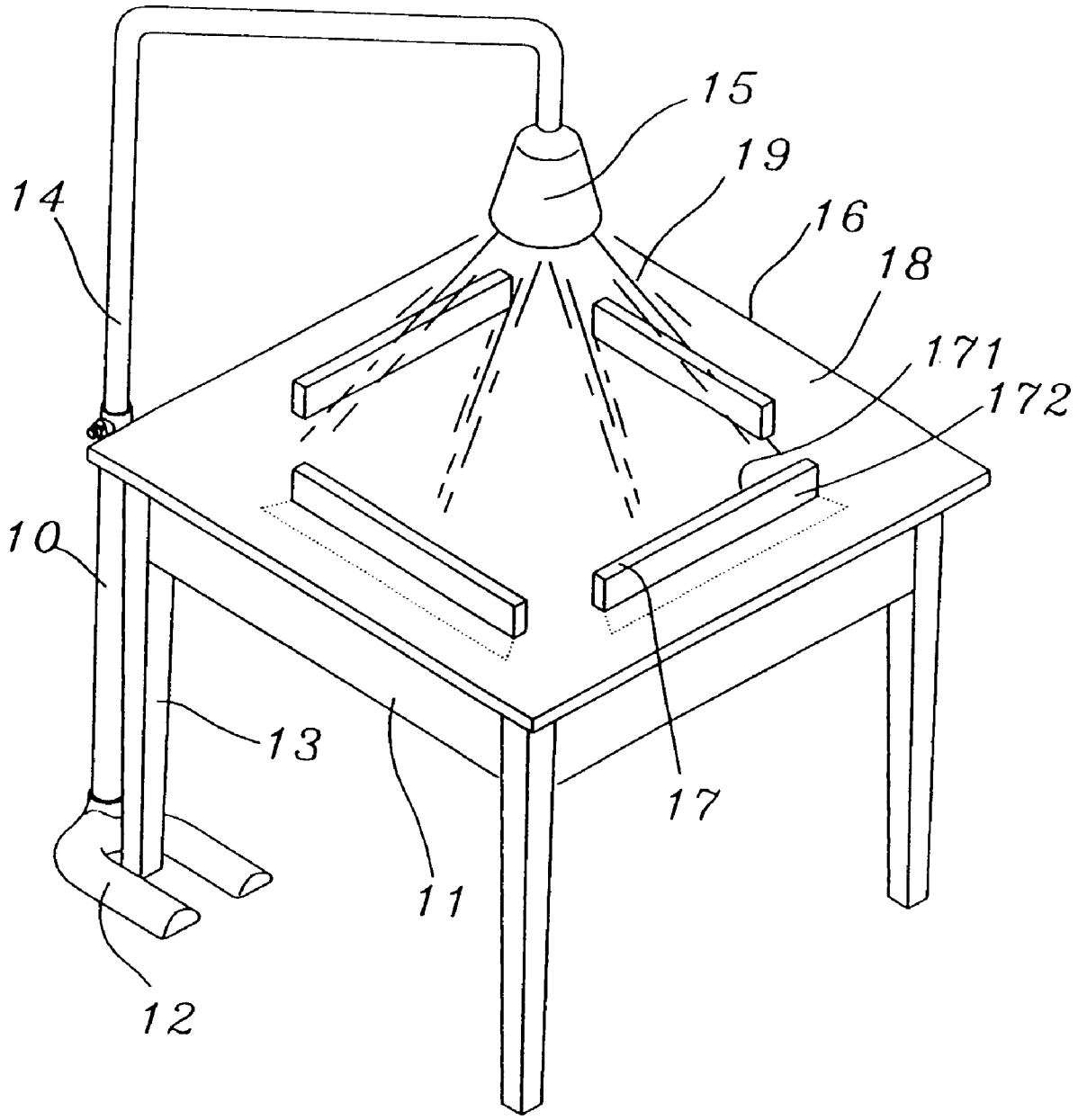
PRIOR ART FIG. 1
FIG. 1 is a schematic view of a floor arm lighting fixture of the prior art standing by side of a table for playing mahjong.
Figure 6:
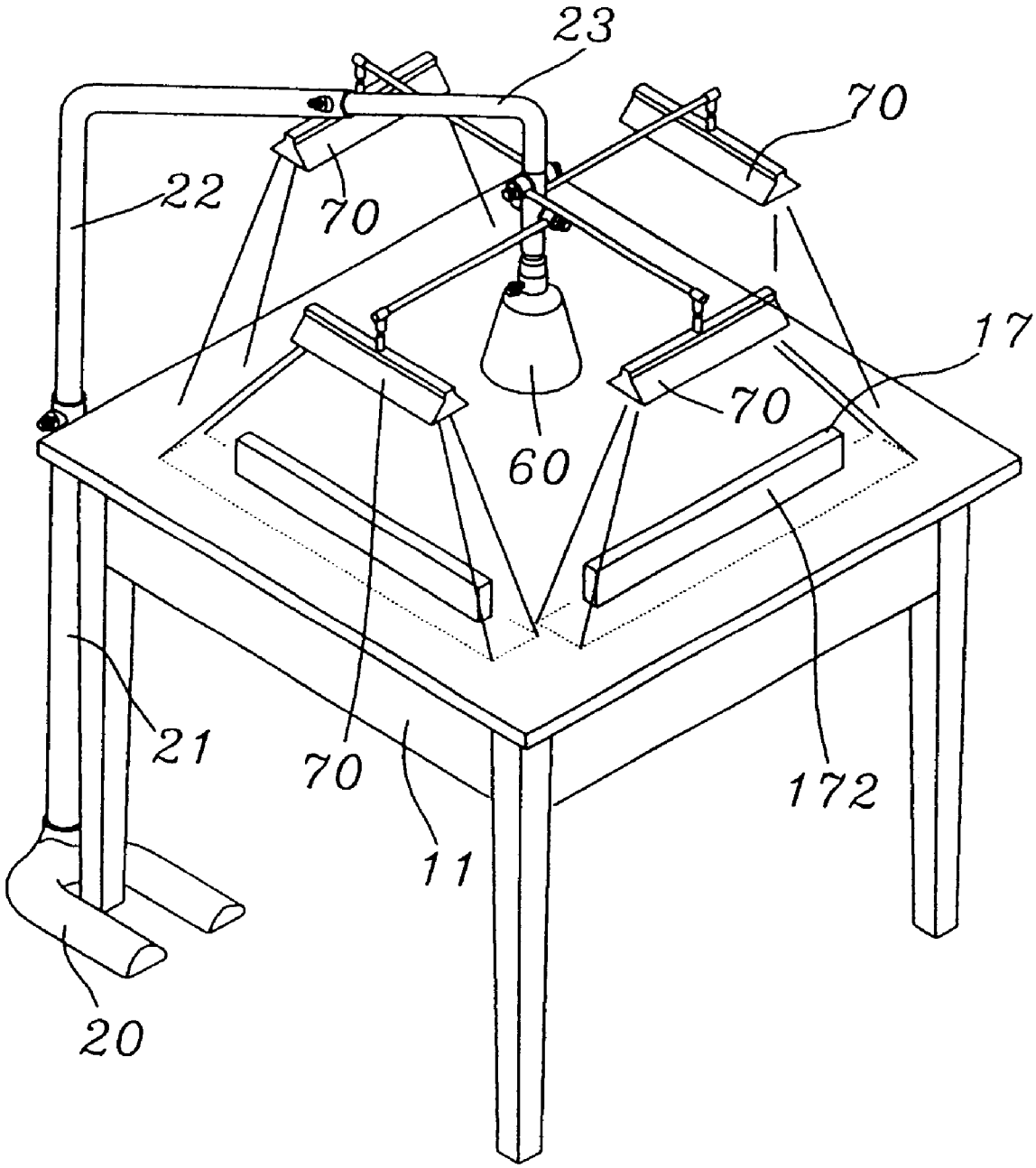
FIG. 6 is a schematic view of the present invention applied to a mahjong table.

Now referring to FIG. 6, the primary light source 52 serves its purpose as that indicated in FIG. 1 to project its light to the table top 18 while each player in front of the edge 16 of the table 11 enjoys the respective lighting from the secondary light source 70 to guarantee ample and comfortable lighting exposure on the side 172 behind the mahjong 17 in opposite to the primary light source 52.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A floor/table arm adjustable lighting fixture, comprising:

a) an arm post, comprising a plurality of sections at a right angle to each other, a first arm post end for connection to a base, and a second arm post end;

b) a first tube connected to said second arm post end, having a plurality of first tube levers extending from an outer circumference of said first tube;

c) a second tube connected to said first tube, having a plurality of second tube levers extending from an outer circumference of said second tube;

d) a shade holding pipe connected to said second tube;

e) a primary light source connected to said shade holding pipe;

f) a plurality of extension levers, each having a first extension lever end and a second extension lever end, the first extension lever end being attached to one of said first tube levers or one of said second tube levers; and g) a secondary light source attached to the each of the second extension lever ends, such that the secondary light sources may be positioned to illuminate an edge of a table.

2. The floor/table arm adjustable lighting fixture as claimed in claim 1, wherein the first extension lever end comprises a connection head having an insertion opening adapted to attach to one of the first tube levers or one of the second tube levers.

3. The floor/table arm adjustable lighting fixture as claimed in claim 1, wherein the second extension lever end is attached to the secondary light source by a universal joint.

4. The floor/table arm adjustable lighting fixture as claimed in claim 1, wherein said secondary light source comprises a light tube and a shade.

5. The floor/table arm adjustable lighting fixture as claimed in claim 1, wherein the first tube levers and the second tube levers are arranged orthogonally with respect to each other.

6. The floor/table arm adjustable lighting fixture as claimed in claim 1, wherein the primary light source comprises a light bulb and a shade.

7. The floor/table arm adjustable lighting fixture as claimed in claim 6, wherein the primary light source further comprises a mobile connection rod connected between the second tube and the primary light source, such that a position of the primary light source is adjustable.

* * * * *